United States Patent [19]

Stine

[11] Patent Number: 4,720,706

[45] Date of Patent: Jan. 19, 1988

[54] METHOD AND APPARATUS FOR ELECTRO-OPTICAL COLOR IMAGING

[76] Inventor: Edward V. Stine, 7201 Grubby Thicket Way, Bethesda, Md. 20817

[21] Appl. No.: 769,336

[22] Filed: Aug. 26, 1985

[51] Int. Cl.[4] ..... G09G 3/06; G09G 3/34

[52] U.S. Cl. ..... 340/783; 340/752; 340/795; 340/766

[58] Field of Search ..... 340/752, 783, 788, 700, 340/784, 795, 766; 350/356, 345, 347 K, 347 E, 352; 358/61, 75

[56] References Cited

U.S. PATENT DOCUMENTS

| | | | |
|---|---|---|---|
| 3,234,329 | 2/1966 | Eisner | 340/795 |
| 3,984,176 | 10/1976 | Hirai et al. | 350/345 |
| 4,042,294 | 8/1977 | Billings, Jr. et al. | 350/345 |
| 4,171,874 | 10/1979 | Bigelow et al. | 350/345 |
| 4,229,095 | 10/1980 | Mir | 358/75 |
| 4,229,783 | 10/1980 | Eberhardt | 350/345 |
| 4,236,791 | 12/1980 | Kruejer et al. | 350/345 |
| 4,330,813 | 5/1982 | Deutsch | 340/783 |
| 4,349,817 | 9/1982 | Hoffman et al. | 350/345 |
| 4,357,625 | 11/1982 | Lamberts et al. | 358/75 |
| 4,367,946 | 1/1983 | Varner | 358/75 |
| 4,378,567 | 3/1983 | Mir | 358/75 |
| 4,378,568 | 3/1983 | Mir | 358/75 |
| 4,386,826 | 6/1983 | Stolov | 350/345 |
| 4,470,045 | 9/1984 | Anderson | 340/783 |
| 4,557,563 | 12/1985 | Sprague | 340/783 |

FOREIGN PATENT DOCUMENTS

| | | | |
|---|---|---|---|
| 0970439 | 10/1982 | U.S.S.R. | 340/752 |

*Primary Examiner*—Gerald L. Brigance
*Attorney, Agent, or Firm*—Walter F. Wessendorf, Jr.; Harold L. Novick

[57] ABSTRACT

Method and apparatus whereby instantly derived emissions of RGB tri-stimulus optical hues are processed into an isotropic field form of radiation for directed transmission through a selected imaging point of an electro-optical imaging screen as a unique point-hue pixel or radiant beam portion of an optical composition being imaged. Embodiments of the invention provide for video or other continuous imaging of contiguous pixels from electrical or optical data source signals. A preferred embodiment of the invention provides for a solid-state flat panel display.

15 Claims, 20 Drawing Figures

FIG. 3
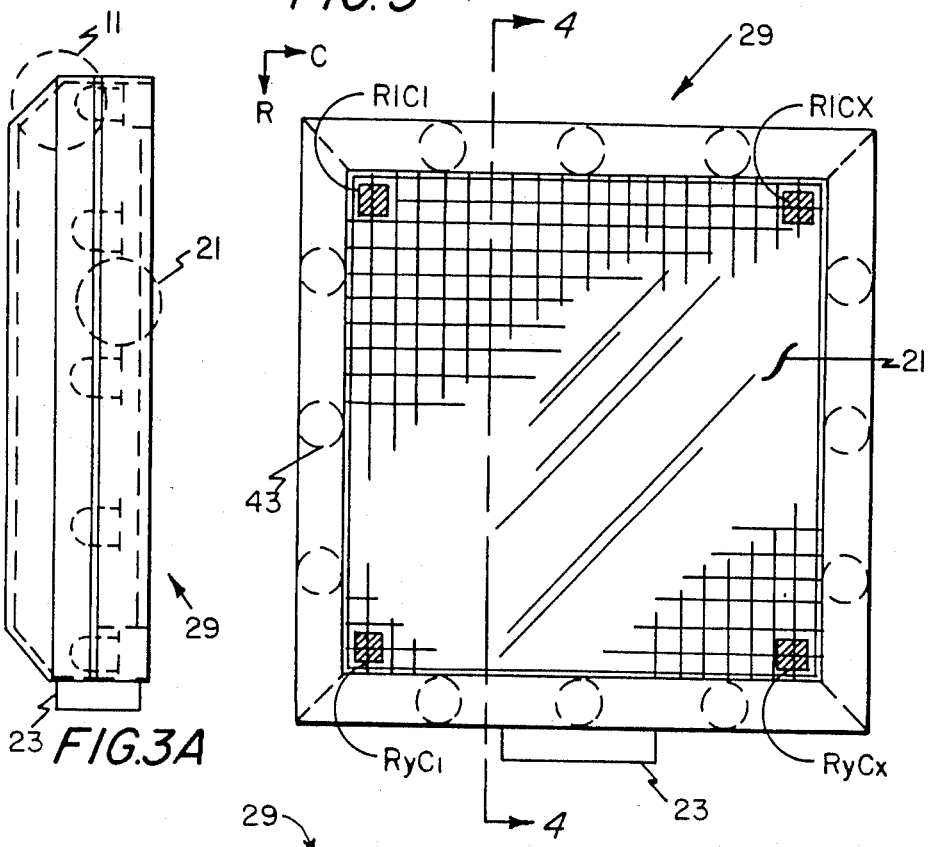
FIG. 3A
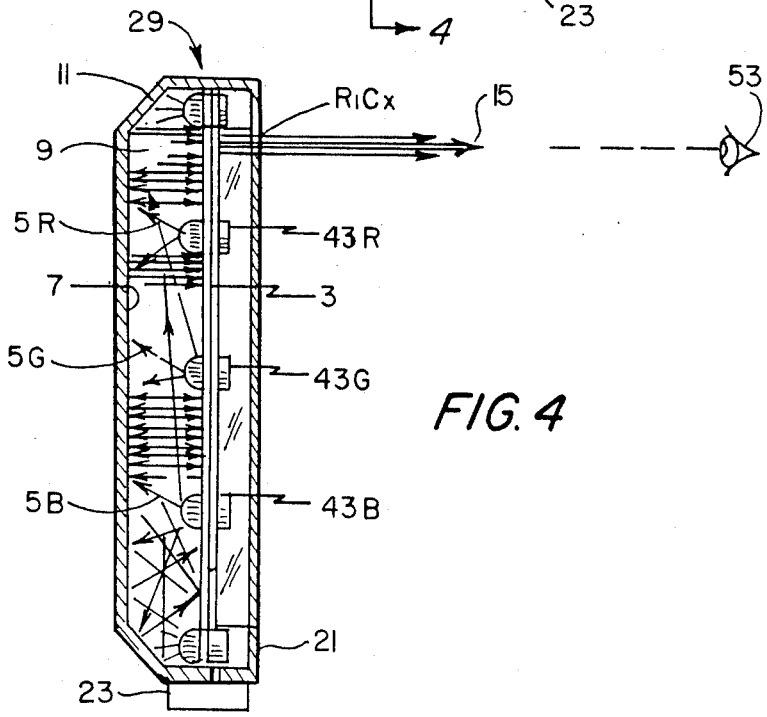
FIG. 4

METHOD AND APPARATUS FOR ELECTRO-OPTICAL COLOR IMAGING

BACKGROUND OF THE INVENTION

1. Field of the Invention

The present invention is in the field of electro-optical imaging, and more particularly relates to systems for converting electrical signals into chromatic radiation for light-gate array decoding in a Flat Panel Display (FPD).

2. Brief Description of the Prior Art

In the prior art, the color Cathode Ray Tube (CRT) has been universally utilized for the conversion of electrical signals into monochromatic or polychromatic images. Its versatility, however, is hampered by its inherent characteristics of geometric distortion, package depth, high voltages, lack of uniform resoultion, susceptibility to shock, gross weight, and the apparent impracticality of achieving large (greater than 35 inches diagonal) or small (less than 2 inches diagonal) image surfaces without projection or optical reduction, respectively.

Of recent interest is the co-called Flat Panel Display (FPD) as is noted in commercial literature (1). This type of display is available today in several varieties (2) known as Gas Plasma (GPD), Electrophorescent or Electroluminescent (ELD), Vacuum Fluorescent (VFD), and Liquid Crystal (LCD).

One prior art LCD, U.S. Pat. No. 4,090,219 (Ernstoff, et al), utilizes sequential color field techniques, variable liquid crystal reflectivity, and active electronics at each pixel site to achieve color imaging. Such displays generally suffer from low image resolution due to slow pixel response, narrow viewing angles, and video bandwidth degradation related to sequential color field operation. System performance attainment is further complicated by the mechanics of color filter switching, the use of field-effect transistors and capacitors at each pixel site, and the requirements for various video shift registers, electric latching, and sample-hold circuitry.

Displays utilizing gas plasma (such as neon and argon ions) are in widespread use, basically as monochrome or tone-on-tone devices. Voltages to activate these gases are high (90–185 volts) compared to those utilized in modern integrated circuitry (15 volts or less, typically). Image refresh times employed (around 200 milliseconds) are considered too slow for standard video. While these devices are relatively thin (3 inches) as compared to the standard CRT, they suffer as the CRT from undersireable weight and, as glass vacuum tubes, are shock-susceptible. Commercially offered ELD and VFD devices, as with FPDs just discussed, have not been shown to be viable alternatives to the color CRT; suffering generally from a lack of orthochromaticity, with slow video response, low bandwidth, and an inability to achieve broad gray-scale intensity shadings.

A method different from all of the foregoing is taught in U.S. Pat. No. 4,170,772 (Bly), wherein vertical strips of alternating red, green, and blue phosphors are arranged across a common transparent front-plane electrode and sandwiched between a plurality of horizontal back electrodes. Upon application of the proper voltage(s) between some horizontal electrode and the front-plane, the sandwiched phosphors are caused to glow and appear as a series of red-green-blue dots repeated the full length of the energized horizontal line. An electrobirefringent light-valve (light-gate) column array, utilizing a type of PLZT Ceramic material in a quadratic (Kerr Cell) format, is placed between the viewer and the horizontal phosphor dot emissions through the front-plane, such that the light-valve columns each address a phosphor dot. When the columnar light-valves are caused to vary transmissivity in response to video signals and while being properly sequenced, an image results.

Phosphor materials are generally not as responsive to steady state current changes as they are to electron beam excitation under vacuum conditions and short high voltage pulses. Further, degradation effects due to charge migration when phosphors are excited by pulsed or steady-state D.C. require alternation of applied voltage polarity periodically as an alleviation; leading to additional switching means. Electrode spacing with transverse (Quadratic) electro-birefringent materials also becomes problematical when interfacing with peripheral drive circuit connections for computer displays and the like. For instance, to provide for 10 volt switching of PLZT Ceramic light-valve arrays, requiring 15,000 V/inch (6,000 V/cm) between transverse electrodes, minute electrode spacing of about 0.00067 inch (0.00170 cm) is required. The electrodes themselves, when utilizing 15% of the spacing, would be only 0.0001 inch in width with a density of 1,500 per inch. Accordingly, apart from small screen scientific, military, or specialized industrial application, broad utilization of PLZT modulated phosphor emission devices as color video imagers has not materialized.

The instant invention contributes to the solution of many of the problems found in the prior art as hereinbefore stated. Utilization of light generators (such as the Laser or LED) to directly emit chromatic radiation totally responsive to the video input signal(s) circumvents the need for CRT electron beam means and the attendant large geometries and high voltages. LEDs, in particular, allow for low video drive voltages (2–10 volts) while providing faster response (10 nanoseconds or less) than other FPD methods discussed. Further, the invention does not possess the complexities presented by active emitters and/or electronics at each pixel site. Through the employment of linear birefringent materials such as Lithium Niobate (LiNb03) in the light-gate decoder, reasonably accessible electrode spacing of 0.008 inch is provided while good image resolution (0.20mm pixel pitch) is maintained. A thin decoder (0.003 cm) utilizing this material provides for optical switching with less than 10 volts.

As will be shown in the preferred embodiment of the invention, extensive circuitry for latching, sample and hold, high voltage drive, and FET-Capacitor pixel site control is not required. Configured in the "solid-state", the embodiment comprises a thin, rugged and practical Flat Panel Display with fast video response for either monochromatic or multicolor imaging. Additional contributions to the art, through the ability of the invention to radiate selectively at various output surface points, enable multi-channel switched transmissions as may be employed for signal multiplex/demultiplexing.

REFERENCES (1) Periodicals:

"Video Signals and Monitor Design", Les Solomon, Dec. 1984 issue, Computers & Electronics, Vol 22, No. 12, Page 53.

"Super - TVs", David Lachenbruch, July, 1985 issue, Popular Science, Vol 227, No. 1, Page 64.

"Flat Panel Display—Apple Computer", Cynthia E. Field, June 1985 issue, inCider—The Apple II Journal, Vol. 3, No. 6, Page 95.

"Flat Panel Color TV", Carl Laron, Dec. 1984 issue, Radio-Electronics, Vol. 55, No. 12, Page 57.

"New Flat Panel Displays", Bob Margolin, Feb. 1985 issue, Computers & Electronics, Vol. 23, No. 2, Page 66.

(2) Instructional Text:

Understanding Optronics, 1981, Masten, Masten, & Luecke, Texas Instruments Learning Center, Dallas, TX Publ. Tandy Corp; Section 5, pp 14–27 incl.

SUMMARY OF THE INVENTION

In the method of the invention, electrical signals are encoded into a non-coherent but unique field of optical radiation which is subsequently decoded for coherent imaging. The invention is referred to by me as the "Chromachron", thereby depicting its attributes of timing and multi-chromaticity. The terms "optical", "hues", "radiation", and "light", are intended to encompass all wavelengths of the electronmagnetic spectrum from the microwave through the x-ray regions; including infrared, visible, and ultraviolet radiations as appropriate to the use(s) of the present invention.

In one embodiment of the invention, the concept rests in a plurality of light sources (two or more) of different hues (two or more) which can include white, being actuated as required to generate conceived different radiant hues as desired within a three-dimensional confining space. Egress of optical radiation from the space is only as provided by the opening of a binary light-gate ("gate") within a group of otherwise closed "gates" arrayed in matrix form within a specified output region of the confining space designated the "Imaging screen". The "gates" within this matrix array, referred to herein as the RyCx light-gates, essentially comprise the imaging screen. In accord with signals instigating the hues, unique "gates" are opened and closed at synchronized points and times by digital actuation so as to provide output(s) through the imaging screen surface. When utilized for TV type imaging, timing and refresh techniques may be used so as to preclude visual flicker of the image mosaic, when it is actually composed of rapidly moving points of various transmitted hues over the entire display surface.

In another embodiment of the invention, radiant hues themselves are trajected into the three-dimensional confining space; thereby precluding the need for actuating light sources within the invention.

The use of Primary or Secondary colors of two or more hues is fundamental, having been researched by Maxwell in 1861 for projecting three color (Red, Green, and Blue) images in registry so as to perceive pictures of various hues. Two color work was done by Hauron in 1895, and subsequent work with two and three color combinations has been accomplished by others, notably Fox and Hickey (1914), Troland (1926), Judd (1940), and Land (1959). In the basic color sciences the CIE chromaticity diagram presents a graphic view of multi-color mix responses, while for communication (Viz: television, color computer monitors, etc.), NTSC chrominance guidelines are often specified.

One fundamental object of the invention, among other objects stated herein, is to provide a viable solid-state flat-panel display alternative to the Cathode Ray Tube (CRT). Within the methods and means of the present invention, such an alternative is realized in an apparatus more efficient in imaging than the CRT; while being of substantially less weight and volume.

Unlike the CRT, the present invention requires no high voltages and, indeed, is operationally compatible with the low signal levels and actuating voltages found in modern day computing and communication circuitry.

Through the method and means of the invention, RGB base video electrical signals (indicative of Red, Green, and Blue colors to be mixed in some proportion for achieving some perceived hue of an image) are applied to the transducers of an electro-optical converter; said converter being an integral part of the encoder of the invention. The convertor, capable of emitting the RGB colors upon excitation, converts the RGB electrical signals directly into the discrete RGB optical radiations required.

It is of no consequence if the emissions from the transducers are of coherent or non-coherent form, so long as the hues, intensity, and duration of emissions are as prescribed by the instigating RGB signals. Among the various types of electro-optical transducers known in the art to be capable of the function(s) required, I have found the solid-state laser or the LED (Light Emitting Diode) to be most fitting for the purpose. In particular, the LED is utilized in a preferred embodiment of the invention.

As prescribed hues radiate from the converter, they are caused to instantly disperse throughout a radiation confining region within the encoder; the "Ganzfeld Distributor". This ganzfeld (entire field) region is so configured as to contain the available radiation in a unique "Ganzfeld Radiation" form, such that the established field is not coherent in the sense of collimation and wave/ray phasing, but is uniform as to hue and field strength, i.e., isochroous and isotropic, within the ganzfield distributor. Methods of the invention provide for the ganzfeld hue to be achieved through either "black-level" or "white-level" base modes; wherein discrete color emissions are, respectively, added or substracted. This ganzfeld radiation possesses no discrete beam and permeates the three-dimensional ganzfeld region as a radiant and uniformly perceived hue having uniform intensity throughout. Totally contained, egress of this radiation is only as allowed through a prescribed surface of the ganzfeld distributor contiguous with the input to the imaging screen of the invention. The ganzfeld distributor function may be enabled through passive optical elements known in the art, with the transmissive containment region being hollow, fluid filled (gas or liquid), solid, granular, or a heterogeneous composite of the foregoing.

The established ganzfeld radiation totally and uniformly transilluminates the imaging screen's input surface, which in a preferred embodiment consists of a transmissive polarizer of film, sheet, or plate form. The output surface of the imaging screen consists of a like polarizer oriented orthogonally to the input polarizer such that one polarizer may pass only vertically polarized light while the other may pass only horizontally polarized light.

Between the two polarizers of the imaging screen resides a transmissive plate (E-B plate) of electro-birefringent material of which several types are known within the art. In a preferred embodiment, a thin Pockels effect linear electro-birefringent material such as lithium niobate (LiNbO3) is employed, having closely spaced transparent electrode lines on each of its surfaces normal to the optical axis. The electrode lines of one side of the E-B plate are disposed orthogonally with respect to the electrode lines of the other side. This composite configuration, viz., two orthogonally disposed polarizers sandwiching an E-B plate having orthogonal electrode lines upon its surface contiguous with the polarizers, comprises an electro-optical light-gate as is known in the art. Further, as there is a plurality of orthogonally disposed electrode lines, a matrix arrayed plexus of minute light-gates (the RyCx gates) comprising the imaging screen of the invention is formed. Voltages applied to the electrode lines activate the light-gates.

This configuration may be visualized as a x-y matrix coordinate system with electrodes being the x and y lines of a tick-tack-toe or checkerboard arrangement wherein the checkerboard-like squares are individually switchable light-gates or "windows" which may be either opened or closed to optical transmissions. It may be further visualized that, should the various hues of an image be transmitted through these "windows" in proper association, a color image mosaic will be perceived; or a monochromatic image perceived should transmissions be of the same hue with intensity shadings.

In the method of switching the light-gates for hue transmission, x-y electrodes are addressed with actuating voltages in a prescribed manner. Such addressing causes a "window" or "windows" (gates) to be opened within the imaging screen light-gate array so as to dictate the time and place within the image mosaic being transmitted that a unique hue, prescribed by some unique RGB signal actuating the system of the invention, emanates as a spot-transmission. The entire light-gate array is scanned, as to space and time, in accordance with RGB signals being applied to the system; thereby rendering the image mosaic as multiple unique spot-transmissions of the prescribed hue(s) through the imaging screen.

Optical radiations derived and switched through the methods and means of the invention have applications within the electro-optic arts other than the imaging of scenes. By coupling the ouput of the imaging screen of the invention appropriately to the input of electro-optical image converting means, such as a CCD (Charge Coupled Device) video camera or other iconoscopic device, radiation emanating from the imaging screen may be converted to analogous electrical signals for storage, demultiplexing, or re-transmission. Further, by coupling fiber-optic or other receptive-transmissive elements to the imaging screen light-gates, the discrete radiant spot-transmission(s) provided through the transmissive elements may be utilized for remote display of scenes or spot-transmissions; or converted to electrical analogs of the chromatic constituents; or distributed throughout a multitude of receptive channels such as would comprise an optical switching or optical demultiplexing system.

Means and methods of the invention may also be applied to multiplexing within electro-optical systems. Conversion of discrete or multiple RGB electrical signals into the ganzfeld type of optical radiation, possessing uniform hue and field strength characteristics, effectively comprises electro-optical multiplexing. Further, the direct conversion of discrete or multiple optically radiant hues, themselves, into the aforesaid ganzfeld type of radiation comprises direct optical multiplexing.

It is thus an object of the present invention to provide apparatus and methods advantageous to the art of color imaging and electro-optical switching.

Another object is to provide means for encoding electrical video color signals directly into generated chromatic radiation with hues responsive to the input video signals.

Another object is to provide method and means for achieving a uniformly encoded radiant optical field directly from a discrete radiant hue, or multiple radiant hues, possessing constituents to be encoded.

Another object is to provide containment, processing and directing means wherein the entire field of radiation generated is substantially coupled to the input of a decoder imaging screen.

Another object is to provide means for electro-optically decoding the encoded radiation to achieve the imaging of scenes or decoded spot-transmission(s).

Another object of the present invention is to present means whereby any portion of a surface illuminated by the encoded radiation contains the same instant intelligence.

Another object of the subject invention is to provide for simultaneously identical multi-imaging within the confines of a decoder imaging screen transilluminated by the radiation generated.

Another object is to provide means and apparatus for multiplying and demultiplexing signals in communications and logic systems.

Another object is to provide an imaging device compatible with computer and telecommunication signal levels and formats.

Another object of the invention is to provide a flat panel display that, in comparison to the color cathode ray tube of the prior art, has the attributes and advantages of thin cross-section, solid-state construction, reliability, low power consumption, and light weight.

A preferred embodiment of the instant invention provides for the direct conversion of electrical video signals into imaging hues.

BRIEF DESCRIPTION OF THE DRAWINGS

FIG. 3 is a view of the Chromachron assembly;

FIG. 3A is a side elevation of the Chromachron assembly;

FIG. 4 is a sectional view taken along the line 4—4 in FIG. 3;

DETAILED DESCRIPTION OF THE PREFERRED EMBODIMENTS

Through the methods and means hereinafter detailed, derived and processed fields of video analog optical radiation are directed to transmit selectively as chromatic pixels; thereby obviating the need for phosphors and electron beams as in the CRT.

Figure 1:
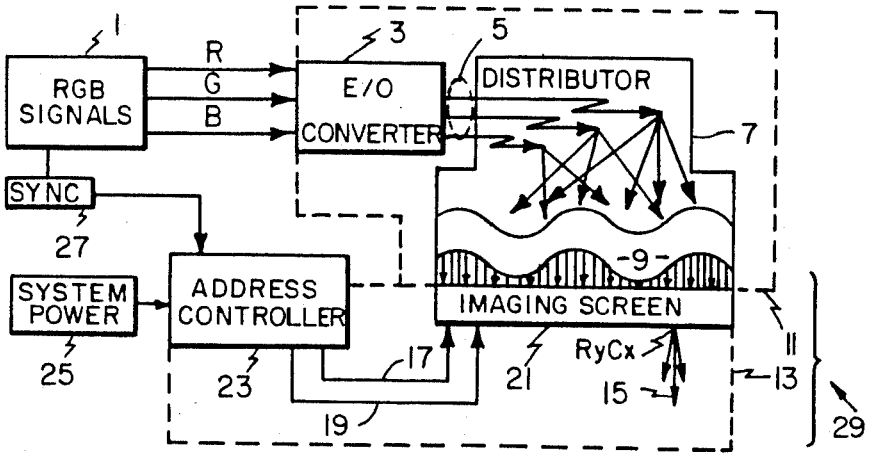
FIG. 1 is a schematic block diagram illustrating the system of the present invention.

Referring now to FIG. 1 of the invention, instant electrical video RGB signals 1 (signals 1), in synchronization with horizontal and vertical sync signals 27, are converted through polychromatic converter means 3 to derive instant optical emissions 5, whose radiation is to be processed and directed for imaging or transmission as a pixel or beam.

Figure 11:
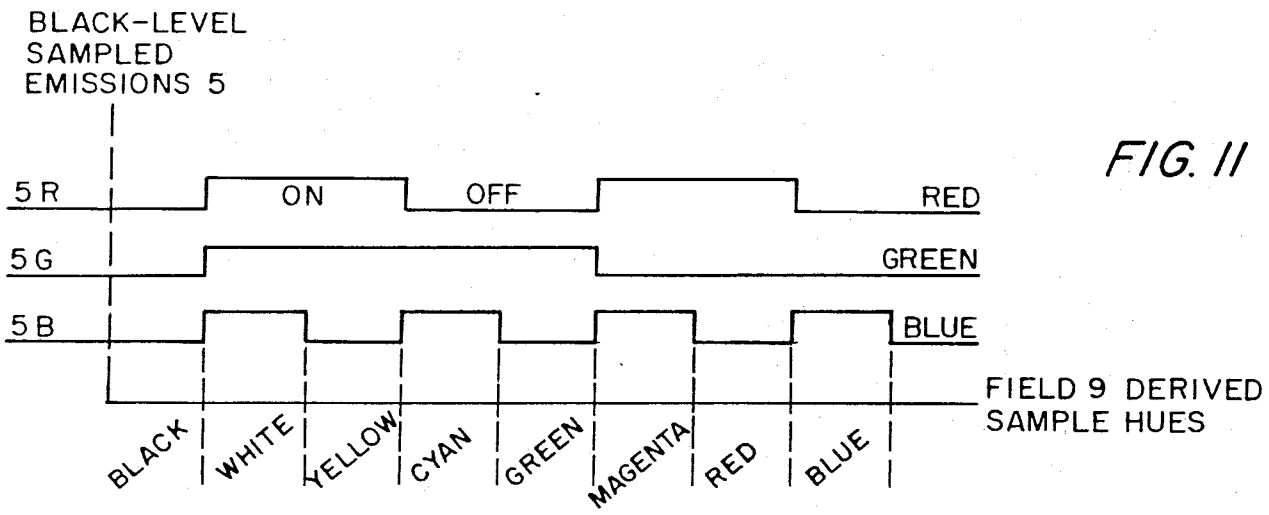
FIG. 11 is an optical emission timing diagram for obtaining chromatic ganzfeld radiation with the invention operating in a black-level reference mode.
Figure 12:
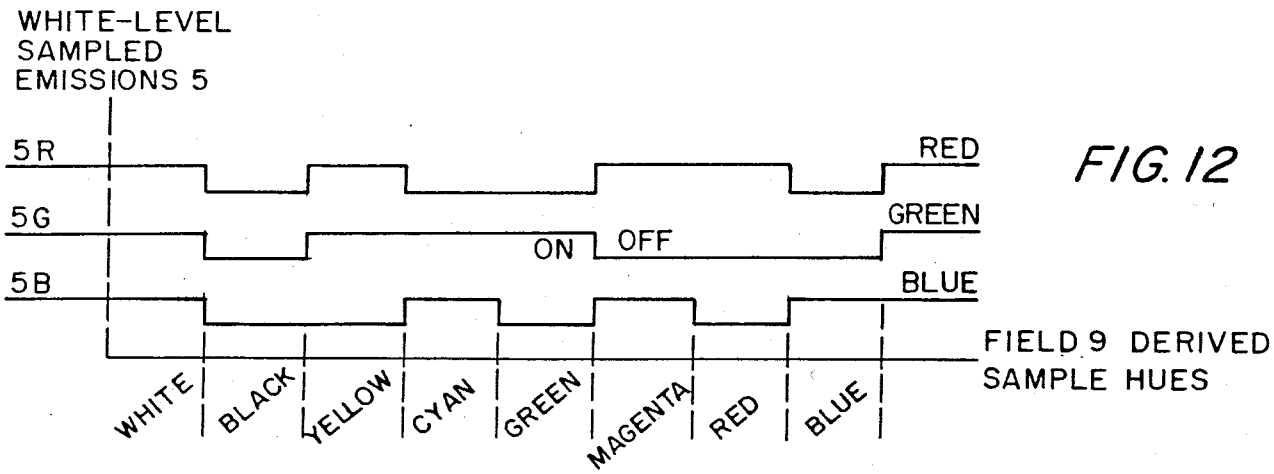
FIG. 12 is an optical emission timing diagram for obtaining chromatic ganzfeld radiation with the invention operating in a white-level reference mode.

Emissions 5 are dispersively processed through ganzfeld (entire field) distributor means 7 of encoder means 11 to become established therein as a constrained and isochroously perceived instant isotropic optical radiation field 9 (field 9), the perceived hue of which is derived by chromatic mixing in a fashion not unlike the samplings or FIG. 11 of FIG. 12.

Field 9 is of the ganzfeld isotropic form, with instant intensity, persistence and isochroous hue (uniform color throughout) being the synergistic optical resultant of the tri-stimulus constituent values of signals 1. Field 9 instantaneously resides in and permeates the three-dimensional region of encoder means 11 conjoining decoder means 13 so as to totally and uniformly transilluminate electro-optical imaging screen means 21, said screen means 21 comprising a contiguous plurality of binary light gate RyCx imaging points to be herein later described.

An instantaneously unique RyCx light-gate imaging point is synchronously selected and actuated by address controller means 23 so as to direct a ganzfeld transmission of the total resident radiation field 9 through said unique RyCx light-gate imaging point of screen means 21 as an imaged optical pixel or radiant beam. Reiterative processing through the foregoing methods and means for each subsequently instant signals 1 provides subsequently instant ganzfeld transmissions of fields 9 through screen 21 as properly timed and spatially oriented contiguous pixels of an optical composition being imaged. Continuous reiteration, or "refreshing" as is known in the art, provides for veridical (true, accurate) imaging without perception of visual flicker.

Supplementing this description with FIG. 2 and FIG. 7 now, decoding method(s) to timely select and actuate a RyCx light-gate imaging point of screen 21, so as to image an instantaneously resident field 9 which is the optical radiation analog of an instant RGB signals 1, will be discussed: Address controller means 23, to be herein later described, accommodated by system power means 25, and synchronized by sync signals 27, activates row address lines 17 and column address lines 19 for the purpose of electro-optical switching within imaging screen 21, said screen 21 comprising a contiguous plurality of selectively transmissive binary light-gates (RyCx gates) arrayed in matrix form and serving as imaging points for directed ganzfeld transmission(s) of radiation field(s) 9 as pixels or beams.

Lines 17 and lines 19 respectively actuate row electrodes 39 and column electrodes 41 of screen 21 with appropriate voltage(s) from controller means 23 so as to enable a synchronously selected opening of a unique E/O (Electro-optical) binary gate RyCx from its remanent closed state. An "open" gate RyCx allows radiation to transmit while a "closed" gate RyCx does not. This unique open light-gate RyCx is selected from among an available plurality of otherwise closed light-gates RyCx arrayed in a row/column (Y/X) imaging matrix format. The radiation input for gates RyCx is input polarizer 47 of screen 21 and the radiation output for gates RyCx is output polarizer 51 of screen 21.

Realize, that from foregoing processes, the unique open gate RyCx is instantly synchronized with the resident optical analog radiation field 9, which is instantly synchronized with RGB signals 1. Realize further, that this field 9 pervades the distributor means 7 section of encoder 11, and contiguously coupled the input of screen 21. And, through the methods and means of the present invention, field 9 is contrived to totally, uniformly, and simultaneously transilluminate the input to all gates RyCx comprising the imaging matrix array of screen 21, but may transmit through screen 21 at an "open" RyCx gate only.

Accordingly, the entire instant radiation field 9 transmits only as directed by controller 23 through the instantly unique open light-gate RyCx of screen 21 as the spot-transmission hue 15. Thus derived, processed and directed, hue 15 is a unique chromatic isochroously perceived beam of said radiation or unique radiant pixel; with said beam (or pixel) possessing all the attributes, including temporal and spatial resolve, attendant to its instigating RGB signal 1; and may be further perceived as one of the pixels of a scene being imaged. Further, hue 15 may be utilized as a discrete optical signal for other applications of the invention to be herein later described.

Elements 1 through 29 of FIG. 1 comprise an embodiment of the operating system of the invention.

Parts 3 through 23 of FIG. 1 comprise the apparatus 29 of the invention.

Parts 3 through 7 of FIG. 1 comprise components of the encoder 11 of the invention.

Parts 17 through 23 of FIG. 1 comprise components of the decoder 13 of the invention.

Elements of the converter means 3, the distributor means 7, the screen 21, the address controller means 23, and other means or methods not found in foregoing descriptions will be hereinafter detailed.

to drive an embodiment of screen 21 containing more than thirty row electrodes 39 or column electrodes 41. In particular, an arrangement of four ICM 7281 drivers connected in tandem and serving as row driver 35 will drive 120 row electrodes; while a similar arrangement may be made for column driver 37.

Figure 6:
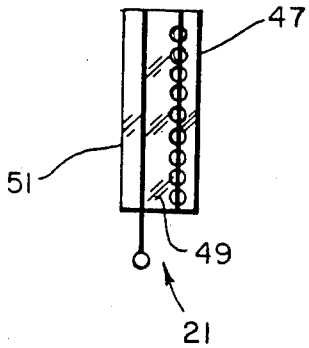
FIG. 6 is a side elevation of the imaging screen assembly.
Figure 6A:
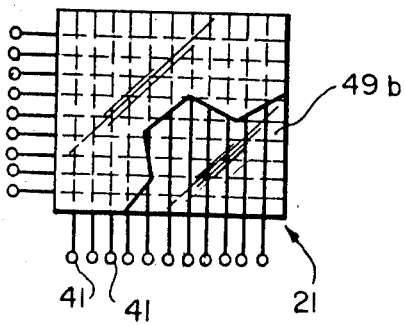
FIG. 6A is an elevation view of the imaging screen output surface.
Figure 6B:
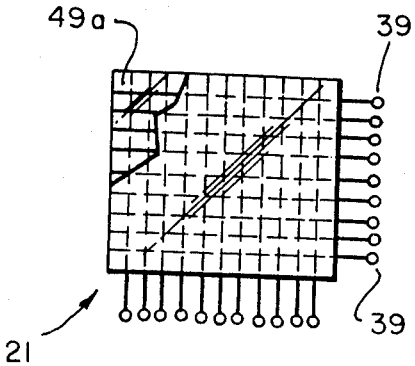
FIG. 6B is an elevation view of the imaging screen input surface.
Figure 7:
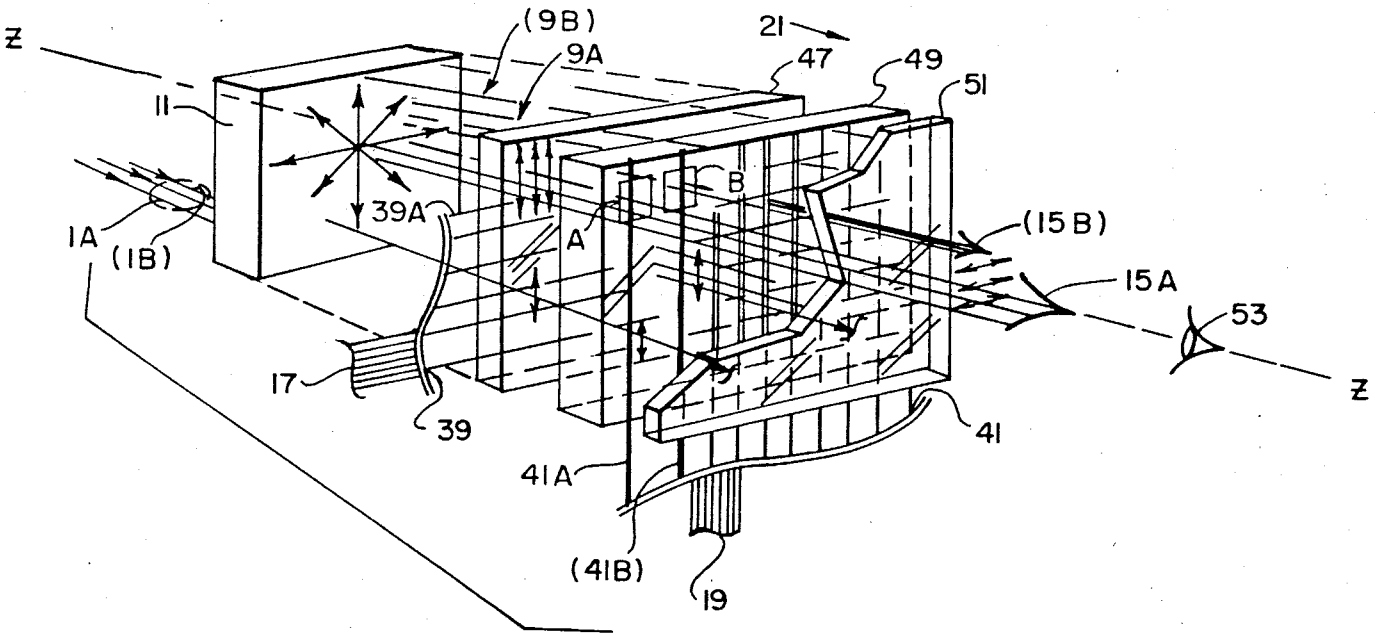
FIG. 7 is an exploded perspective view of the chromachron device.

FIG. 6, FIG. 6A, and FIG. 6B are views depicting a preferred embodiment of the screen 21 of which FIG. 7 contains an exploded perspective view. Radiation field 9 is coupled into screen 21 through input polarizer 47, which is any suitable transmissive linear polarizer plate, sheet, or film such as Polaroid Brand HN32 or HN38S. The output polarizer 51 of screen 21 consists of a like polarizing material oriented orthogonally to the input polarizer such that one polarizer may pass light in the sense of a vertical plane, while the other polarizer may only pass light in the sense of a horizontal plane. It is of no consequence to the instant invention which polarizer is of the vertical sense, so long as the other possesses a horizontal sense (or crossed, as is known in the art).

Between input polarizer 47 and output polarizer 51 is emplaced a transmissive E-B (Electro-birefringent) plate 49, the material of which may be one of the several types known within the art. Linear (Pockels effect) E-B materials such as Lithium Niobate (LiNbO3), Lithium Tantalate (LiTaO3), Potassium Dihydrogen Phosphate (KDP) and its deuterated form (KD*P), may be employed; the first two being non-hygroscopic. It is further known to utilize quadratric or transverse (Kerr effect) E-B materials such as Lanthanum modified Lead Zirconium Titanate (PLZT), a fragile heterogeneous ceramic substance, and nitrobenzene, a toxic liquid. Additionally, nematic liquid crystals may be alternatively employed in some slower response applications of the invention and, when contained in plate or sheet form, may be directly substituted for plate 49. For fast video and communication response, however, liquid crystals are not preferred as they respond relatively slow to switching voltages, and suffer from temperature degradations.

In a preferred embodiment of screen 21 shown in FIG. 6, a thin Pockels effect E-B plate 49 of LiNbO3 crystalline material is employed, having closely spaced parallel electrode lines placed on each of its surfaces contiguous to input polarizer 47 and output polarizer 51, and normal to optical axis Z as shown in FIG. 7. Electrode lines 39 on the one surface of plate 49 are disposed orthogonally with respect to electrode lines 41 on the opposing surface of plate 49. While FIG. 2 and FIG. 6 show nine lines 39 and eleven lines 41, other appropriate quantities may be employed in utilization(s) of the invention. Voltage applied between these opposing orthogonal electrodes causes an electric field to be established within plate 49 in a sense parallel to optical axis Z; said electric field being discrete at some point, or points, determined by the geometrical row/column relationship of electrode lines 39 and 41 within the screen 21 to which voltages are applied.

Electrode lines 39 and 41 may be depositions of virtually transparent electrically conductive materials which can be metals or metallic compounds such as gold, silver, copper, aluminum, indium, tin oxide, or indium-tin oxide (ITO); and, in a preferred embodiment, consist of transparent vacuum depositions of ITO.

Figure 2:
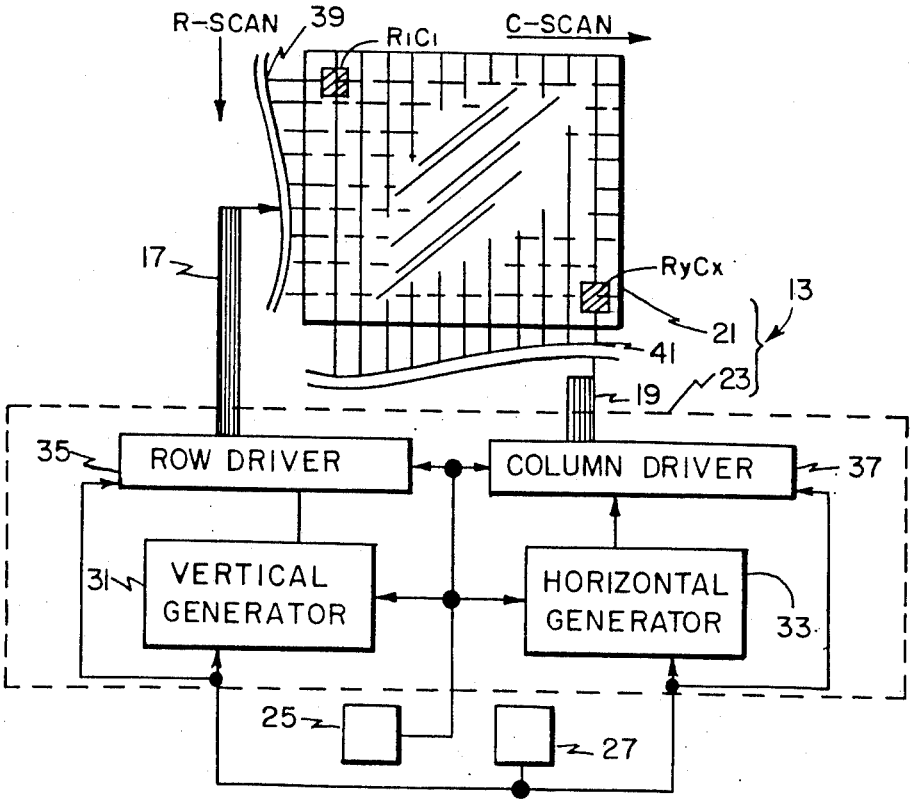
FIG. 2 is a schematic block diagram of the decoder comprising imaging screen and digital driving means.

Referring now to FIG. 7 and FIG. 2 a description of screen 21 functioning to provide a transmission hue 15A through the light-gate R1C1 designated "A" will be given. Gate R1C1 is the first of the RyCx decoder light-gates; situated at row 1, column 1 as shown by FIG. 2 of the invention.

By the methods and means herein before described, RGB signals 1A of FIG. 7 may be transduced and processed into radiation field 9A so as to transilluminate decoder input polarizer 47; said polarizer being of a vertical sense in this instance. In the absence of screen 21 actuating voltage(s), field 9A will extend through input polarizer 47 and E-B plate 49 as a vertically polarized optical embodiment of signals 1A. Transmission of field 9A to egress screen 21 will not be allowed, however, as output polarizer 51 is oriented so as to pass only radiation of a horizontally polarized disposition.

At the instant electrode lines 39A and 41A attendant to light-gate A (R1C1) are actuated by the proper voltage(s) through row address lines 17 and column address lines 19 from address controller means 23, however, E-B plate 49 changes from an isotropic to a birefringent state in the domain of gate A only. Through this action, the vertically polarized radiation of field 9A is effectively rotated 90 degrees so as to be horizontally disposed at horizontal output polarizer 51. Accordingly, and so disposed, field 9A transmits through screen 21 as hue 15A perceived by the eye 53 at a unique pip determined by the light-gate R1C1.

Realize that a subsequently activated light-gate R1C2 {1st row electrode line 39A, 2nd column electrode line (41B)}, at a point "B" will synchronously allow transmission of a subsequent field (9B) through screen 21 as a hue (15B); should a subsequent signal (1B) for transduction through encoder 11 be applied (gate A at R1C1 will be closed). Proceeding thusly, and as all RyCx light-gates of screen 21 may be synchronously actuated, or "scanned", in a prescribed TV type manner in accord with RGB signals 1 presented to the encoder 11, scenes or other images may be obtained. "R-scan" and "C-scan" directions shown in FIG. 2 of the invention are such as to accommodate the conventional scanning format generally utilized in such application(s).

It will prove illustrative, now, to utilize the instant invention in E/O switching and imaging applications. For a television example, and referring now to FIG. 1, and FIG. 2, synchronized RGB signals 1 are applied to converter 3 at levels adequate to drive transducer means 43.

Through the function(s) of encoder 11, emissions 5 from transducer means 43 are processed into video analog optical radiation which appears as field(s) 9 at the screen 21 input polarizer 47. Sync signals 27 and power means 25 activate address controller means 23 of decoder 13, thereby providing digital row and column pulses for the scanning of binary light-gates RyCx in screen 21. Synchronous radiation fields 9 transmit through the synchronously opened RyCx gates as hues 15 at pips attendant to RGB signals 1; thus enabling the imaging of scenes.

Methods and means of the invention provide for E/O response and switching times substantially in excess of 4 MHZ, thereby readily accommodating the practical video bandwidths of commercial TV. Configuring screen 21 as a 256×256 row/column light-gate array provides for 65,536 pips/scene which, when repeated 60 scenes/second enables an OSD (On-Screen-Display) bandwidth of 3.932 MHZ; also appropriate to practical TV imaging. In a controlled application, such as closed circuit TV, this 3.932 MHZ figure could be the pulse repetition rate for horizontal generator 33. In the instant application, however, an accommodation for the 60 HZ vertical and 15.75 KHZ horizontal sync rates of commercial television must be made. Accordingly, the pulse rate for horizontal generator 33 will be set to 4.032 MHZ so as to provide for 262.5 Ry rows ×256 Cx columns; understanding that the 6.5 rows beyond R256 are virtual and not part of the OSD.

Columns C1 through C256 can now be reiteratively scanned 15,750 times per second, at 63.5 microsecond/-scan, by means of digital pulses provided by means 33 through driving means 37. Horizontal generator 33 contains dual 50% duty cycle pulse sources operating in a phase alternation mode for an approximate 100% duty cycle; thereby providing 248 nanosecond pulse widths at a 4.032 MHZ rate. These pulses are distributed by column driver 37 through lines 19 to electrode lines 41. Sync signals 27 provide for the 15.75 KHZ video synchronization of both horizontal generator 33 and the reiterative Cx column scanning function of column driver 37.

While progressive (non-interlaced) scanning CxRy rows is established for simplicity of example in this instance, understand that a full 525 line interlaced row scan mode could be utilized; and that such a configuration of the invention is not beyond the attainment of those skilled in the art. Vertical generator 31, then, may operate at a rate of 15.75 KHZ for either row scan mode; while providing approximately 100% duty cycle pulse widths of 63.5 microseconds to row driver 35 in a fashion not unlike the method(s) employed for horizontal generator 33. Through lines 17 to row electrodes 39, row driver 35 sequentially activates rows R1 through R256 in a R-scan, while a C-scan sequences columns C1 through C256 completely during each row activation time of 63.5 microseconds.

Row driver 35 is essentially dormat for the 6.5 row pulses following each 256 row scan iteration, at which time the next 60 HZ vertical sync pulse of signals 27 applied to driver 35 causes row scan reiteration. This same sync pulse may be utilized to simultaneously synchronize the pulse train of vertical generator 31 with a reset, thereby alleviating any partial pulse timing problems. The 15.75 KHZ pulse repetition frequency of vertical generator 31 may readily be synchronized with system sync signals 27 by those skilled in the art.

Through the means and methods described herein, synchronizing the system of the instant invention appropriately with RGB signals 1 will provide for synchronously attendant transmission of field(s) 9 as hue(s) 15 through the RyCx light-gate imaging screen 21; thereby providing for the veridical imaging of scenes.

Figure 13:
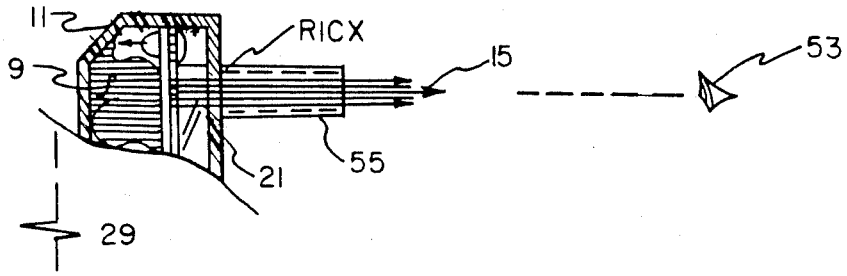
FIG. 13 is a partial sectional view of the Chromachron device depicting transmissive optical guides coupled to the imaging screen.

Other applications of the present invention will be briefly illustrated by referral to the drawing figures. FIG. 13 is a partial section view of the apparatus 29, derived from FIG. 4, wherein a fiber-optic or other transmissive light guide means 55 is coupled to the screen 21 output at light-gate R1Cx. The field 9 transmission as hue 15, derived, processed and directed through the means and methods of the invention hereinbefore detailed, is compelled to follow the course of guide 55, which need not be rigid or straight, for remote viewing as by the eye 53, or for other spot-transmission use.

Multiple light-gates RyCx of screen 21 could each be likewise coupled with similar guides 55 for the conduction of various spot-transmission hues 15; thereby enabling the remote imaging of entire scenes. Should each of these guides 55 be coupled to, and switched by, individual RyCx gates, there will be separate channels for the guiding of each unique hue 15 to separate and distinct reception points; thereby providing for optical communication switching and/or multiplex/demultiplexing. Hue 15 outputs at these reception points may be further optically processed, or converted into electrical analog signals 61 through P/E (photo-electric) detection means 57 of FIG. 14.

Figure 14:
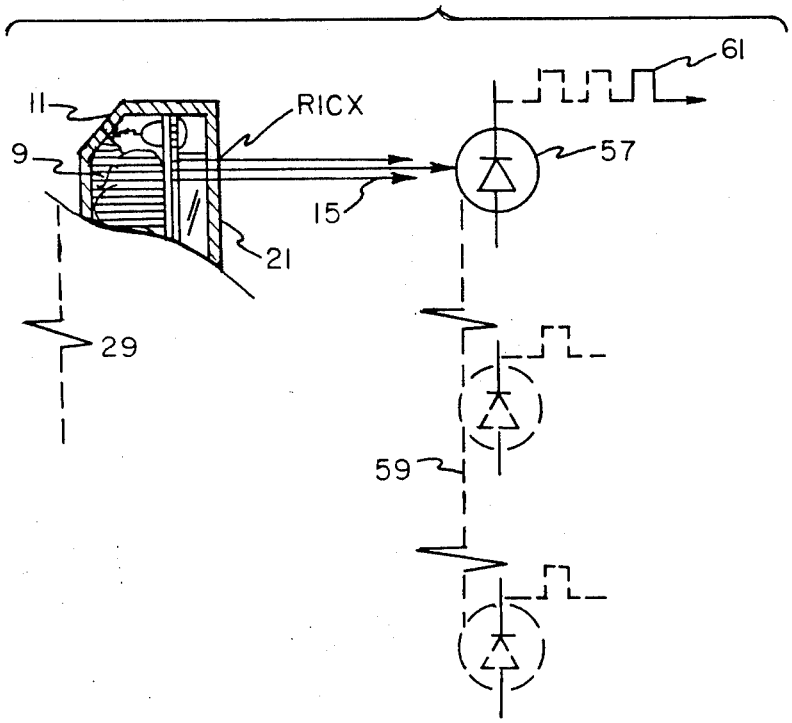
FIG. 14 is a partial sectional view of the Chromachron device depicting spot-transmission(s) detected by photo-electrical means.

FIG. 14 shows a discrete hue 15 from screen 21 impinging on P/E means 57 to establish electrical analog signal 61. Additionally, by use of optical separation means, e.g. filters, prisms, or gratings, hue 15 may be readily separated into its primary or other color constituents. Should each of these color constituents likewise impinge upon P/E detectors similar to means 57 of P/E bank 59, then an electrical analog of each such constituent of hue 15 will be provided. By these means and methods, then, discrete electrical analog signals 61 may be obtained from discrete optical hues 15, or from the color constituents of hues 15, for subsequent application(s) within the art(s).

Guide 55 may be of conventional transmissive material such as fiber-optic, glass, plastic, crystal, ceramic, or epoxy; or of hollow non-transmissive opaque material such as metal, wood, rubber; or hollow opaque glass, plastic, crystal, ceramic, or epoxy; and may be solid, hollow, or a hollow filled with transmissive fluid, transmissive particles, or a composite; and may be flexible or not.

P/E detector means 57 may be conventional; with devices such as photodiodes, phototransistors, solar cells, and photomultipliers being among the many known to the art.

P/E bank 59, as shown in FIG. 14, may be a charge-coupled device (CCD) array, or other video camera type P/E image detector. When appropriately coupled to the output imaging surface of screen 21 of the invention, means 59 will enable each hue 15 within an output image mosaic to address a unique P/E detector 57; thereby providing electrical signals 61 proportional to the intensities of the hues 15. Signals 61 so obtained may be utilized as electrical analogs of images or scenes from screen 21 for further video applications. These electrical analogs may also be considered data transmission output signals should the invention be utilized for communications and/or data switching.

Figure 15:
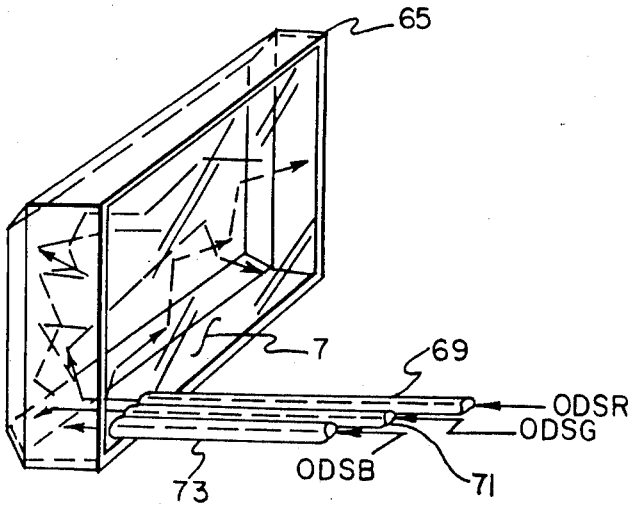
FIG. 15 is a view of another embodiment of the distributor means shown as passive optical processing means having coupled light-guide means for intertrajection of optical signals.

FIG. 15 depicts distributor means 7 as comprising passive optical processing means composed of transmissive refractive-dispersive materials such as glass, plastic, ceramic, or epoxy with light-guide means 69, 71, and 73 coupled so as to allow direct Optical Data Sources signals to traject into means 7. These ODS signals, illustratively shown as ODSR, ODSG, and ODSB for Red, Green, and Blue optical signals respectively, may serve alternatively as emissions 5 so as to be processed into radiation field(s) 9 for decoding through screen 21 of the invention as hereinbefore described.

Figure 16:
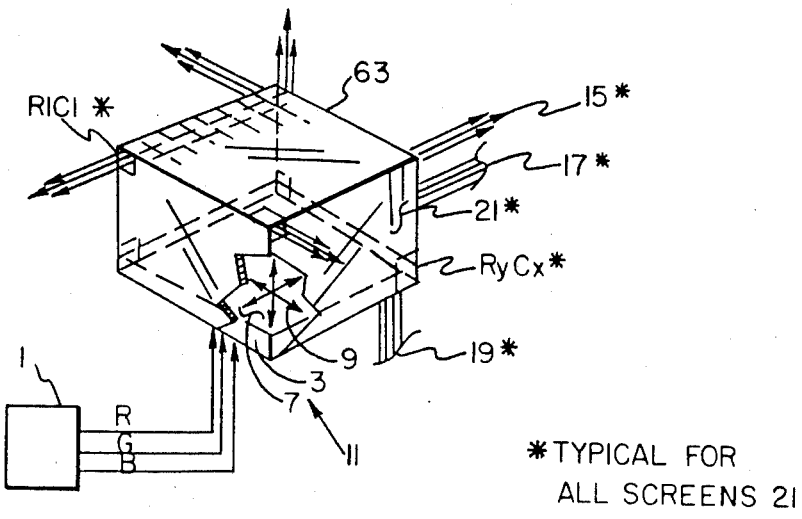
FIG. 16 is a line drawing of an imaging cube depicting multiple imaging screens providing multiple images from the same instant gansfeld radiation field.

FIG. 16 illustrates a paramount and unique capability provided through the methods and means of the present invention. Radiation fields 9, of the ganzfeld form, and derived, processed and directed as hereinbefore described, are able to simultaneously couple and provide imaging hue(s) 15 through multiple screens 21 connected in parallel to the means of the system of the invention.

Two screens 21 may be coupled with radiation field 9 so as to provide identical images or spot-transmissions on opposite sides of a flat panel display without increasing the thickness; or many screens 21 may be coupled to RGB signals 1 are electrical signals indicative of the Red, Green, and Blue optical content to be established in the radiation field 9, and possess the analog attributes of amplitude and duration proportional to a related optical constituents's contribution to the field 9. As presently practical video cameras and picture tubes pick up and display only luminance based information, a TV camera resolves a color scene into red, green, and blue separation images focused on three respective camera tubes. Output voltages Er, Eg, and Eb of these tubes, being proportional to the intensities of the three color primaries, are processed into a "composite video" form (PAL or NTSC) for RF carrier modulation.

RGB signals 1, to be provided to converter means 3 of the invention, are of the camera output form (Er, Eg, Eb), and not of the "composite video" form; and are referred to herein as the "RGB" or "base video" form, being synchronously associated with sync signals 27.

Synchronization of the interrelated processes of the invention, wherein base video signals 1 are encoded by encoder 11 into fields 9 for transmissions through screen 21 as hues 15, is provided by the application of sync signals 27 to address controller means 23. The utilization of electro-optical image process synchronization signals is well known in the art and their derivation and application is a common practice of those so skilled. Specifically, signals 27 may be the horizontal and vertical sync signals inherent to conventional TV systems, should the present invention be so employed, or may be any other specific type of sync signals required in other specific application(s).

RGB or "base video" signals are readily available today from a variety of sources, such as television video data sources, computer video data sources, recorded video data sources, and telecommunication video data sources for image data transmission. All such and similar sources of RGB signals 1 (signals 1) are collectively referred to herein as "video data sources". Further, electrical video data source signals (VDS signals) are electrical signals providing not only signals 1, but the attendant synchronization signals referred to herein as sync signals 27.

When applications for processing of radiation for imaging or transmission through the methods and the means of the present invention utilize direct optical input signals rather than electrical RGB signals 1 to be converted, so as to constitute directly applied optical emissions 5, then such optical signals serve as optical video RGB signals and will be deemed to have been provided from Optical Data Sources as "ODS" signals to be distinguished from "VDS" signals. In such instances, then, sync signals 27, if required, are to be synchronously attendant to the ODS signals and provided therewith.

An instant and obvious example of ODS signals lies in the present invention, itself, wherein RGB signals 1 have been converted to optical field(s) 9 for directingly decoded transmission through imaging screen 21 as hues 15 constituting unique chromatic radiant pixels or beams; said pixels or beams having further utility when trajected (transmitted as light or color) through transmissive guides coupled to the output of screen 21. Red, green, and blue (other hues may be employed) optical beams so trajected may be utilized as color pixel tristimulous constituents of optical video RGB signals; thereby providing a type of ODS signal. Other known examples of ODS signals include optical transmission signals in fibre-optics systems; LED and LASER optical systems in free space, contained vacuums, liquids, gas, and transmissively guided communications systems; and optical strobe and tachometer signals utilized in optical processing systems. ODS and VDS signals may generally be referred to herein as IDS (imaging date source) signals.

System power means 25 may be conventional, so as to provide 15 volts D.C. to address controller means 23 in a preferred embodiment utilizing integrated circuits; with total required power, and possibly other voltages, dependent upon factors specified by the manfacturer(s) of such circuits. Power means 25 may be simply a battery or any other source providing similar power.

FIG. 2, in conjunction with FIG. 1, illustrates methods and means for actuating screen 21 such that a proper gate RyCx is opened for the transmission of a unique hue 15 at its pip (pixel imaging point). Power means 25 and synchronizing signals 27 serve to appropriately activate generators 31 and 33 and drivers 35 and 37 within the controller means 23; thereby actuating multiple address lines 17 for row electrodes 39 and multiple address lines 19 for column electrodes 41.

Depending upon the driving-pulse and timing characteristics generated by means 23 in application(s) of the invention gates RyCx may be discretely addressed for actuation or continuously scanned in a TV type raster format; thereby enabling the pips of screen 21 to sequence for imaging in TV type systems. When so employed, the conventional scanning is top row to bottom row while columns scan left to right.

Various similar techniques for row/column addressing of light-gates are known in the art; with examples being found in U.S. Pat. No. 4,090,219 (Ernstoff et al), U.S. Pat. No. 4,170,772 (Bly), and in the many commercial computer and TV type products available today employing LCD and other flat panel displays. It will be understood, therefore, that the matrix type addressing format for screen 21 of the present invention is not unlike the conventional.

Note, however, that the fundamental functions of the RyCx gates in the methods of the present invention differ from the usual. Specifically, gates RyCx are not utilized to modulate the intensity of field 9, or any other optical radiation, as it passes through the screen 21 for transmission as hue 15. Further, these RyCx light-gates are not utilized for the modulation of discrete chromatic emissions, reflections, or refractions so as to formulate a prescribed hue or hue shading; nor for the shading of a monochromatic optical hue throughput, reflection, or refraction, as is known in the art. The purpose of gates RyCx is to provide for the egress of the fields 9 through the screen 21 at pips attendant to the time and place requirements of RGB signals 1.

To the extent foregoing, then, RyCx light-gates of the present invention are functional binary elements operated in either of two states at any instant; i.e., either open or not open for the transmission of field 9 as hue 15. Understand that the color and intensity perceived as hue 15 are predisposed in radiation field 9. Accordingly, a lack of hue 15 at a synchronized pipe does not indicate a RyCx gate closure to create a 100% black pixel; on the contrary, it indicates field 9 has instantly ceased and the pixel hue is black as prescribed by RGB signals 1.

Referring to FIG. 1, FIG. 3, and FIG. 4, now, encoder 11 is shown as a section of apparatus 29. Comprising encoder 11 is converter means 3 and distributor means 7, oriented such that any beamed optical emissions 5 (5R, 5G, 5B for Red, Green, and Blue, respectively) generated by color trandsucer means 43R, 43G, and 43B, driven by RGB signals 1, are unable to directly radiate upon the input polarizer 47 of screen 21 shown in FIG. 6 and FIG. 7. Rather, these emissions 5 are trajected into distributor means 7 for dispersion therein; thereby establishing radiation field 9 for coupling with input polarizer 47.

Figure 5:
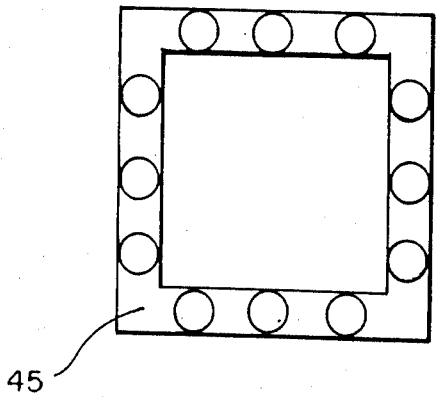
FIG. 5 is a view of the converter means of the invention.
Figure 5A:
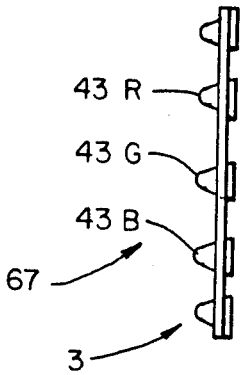
FIG. 5A is a side elevation of the converter means of the invention.

In the preferred embodiment of FIG. 5, converter means 3 consists of a simple supporting frame 45 containing transducer means 43. In conjunction with FIG. 3, transducer means 43 is shown as consisting of four banks 67 containing an example of three emitters (transducers) each (43R, 43G, 43B for Red, Green, and Blue emitters, respectively), mounted in frame 45 so as to be peripheral to screen 21 within the chromachron device 29. While in FIG. 4 and FIG. 5 one bank 67 is shown possessing polychromatic capabilities, with more than one emitter for each discrete hue being allowable, realize that other arrangements could be employed. Such arrangements could include methods whereby each bank 67 might consist of multiple single-hue emitters, or just one single-hue emitter; thereby requiring a unique bank 67 for each monochromatic constituent of emissions 5 prescribed by RGB signals 1. Alternatively, a single polychromatic bank 67 could be employed.

Transducer means 43 are E/O (Electro-optical) devices capable of deriving emissions 5 from RGB signals 1. Many such devices are known in the art; the most prevalent being the incandescent, phosphorescent, fluorescent, plasma or gas-discharge, electric arc, metallic vapor, and the Laser and LED types. The latter two being known for their rapid E/O conversion times in the nanosecod/picosecond domain so as to be useful in Video Light Generators for rapid scan TV and communications, while the first types are useful for slower scan imaging and data displays.

The employment of LED emitters for transducer means 43 proves useful to applications of the invention where economy, size, rapid response, and ruggedness are desired; and particularly in solid-state embodiments of the invention for use in video imaging and communication switching. Commercially available from companies such as Dialight (Brooklyn, NY), IDI (Edgewater, NJ), and Inter-Devices (Anaheim, CA), LEDs are available with various discrete color emissions and output intensities ranging up to 3,000 med (millicandela) and beyond. Semi-conductor materials utilized for both solid-state Lasers and LEDs include gallium, aluminum, arsenic, phosphorous, indium and nitride compounds.

Figure 10:
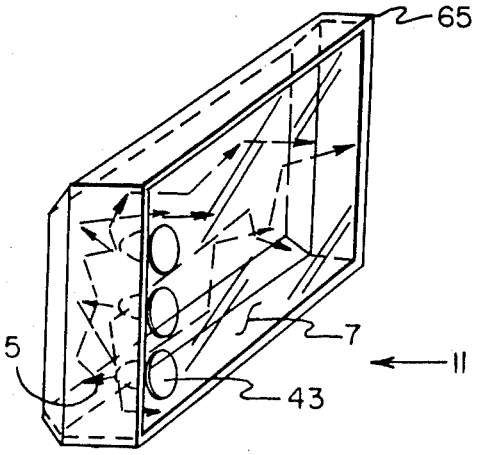
FIG. 10 is a view of the preferred embodiment of the distributor means shown as a solid transmissive refractive-dispersive substance.

Frame 45 for transducers 43, as shown in FIG. 5 is configured for mating with the encoder 11 and the screen 21 of the invention. The material of frame 45 is preferably aluminum, but may be of any appropriate substance such as plastic, wood, metal, or glass. Frame 45 may even be dispensed with completely, should transducer means 43 be imbedded into distributor means 7 as shown in FIG. 10.

Referring now to FIG. 1, FIG. 4, FIG. 7, and FIG. 3A, distributor means 7 is seen as a three-dimensional confining space whose limits are the input polarizer 47 of screen 21 and the inside surface of the encoder housing 65. The screen 21 input polarizer 47, to be herein later detailed, is a linear polarizer providing the sole means for radiation field 9 to egress the encoder 11 and ingress the screen 21.

The function of distributor means 7 is to process emissions 5 of transducers 43, in a passive dispersive manner, so as to create a radiation field 9 of uniform hue and intensity totally and uniformly transilluminating the input polarizer 47 of the screen 21.

Figure 8:
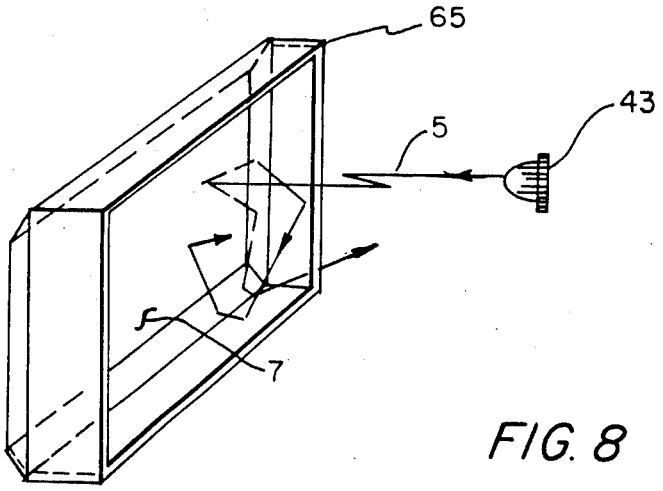
FIG. 8 is a view of another embodiment showing a simple housing defining the distributor means.

In the embodiment represented by FIG. 8, the encoder region of distributor 7 is shown as a simple housing, hollow or fluid filled, the outer surface of which is the encoder housing 65 with the inside surface having highly reflective-refractive-dispersive optical characteristics. Deposited or polished mirrors, thin plastic, glass, or crystalline refractors, or a white coating may be employed. Other dispersive methods for establishing the ganzfeld radiation field 9 are shown in FIG. 9 and FIG. 10.

Figure 9:
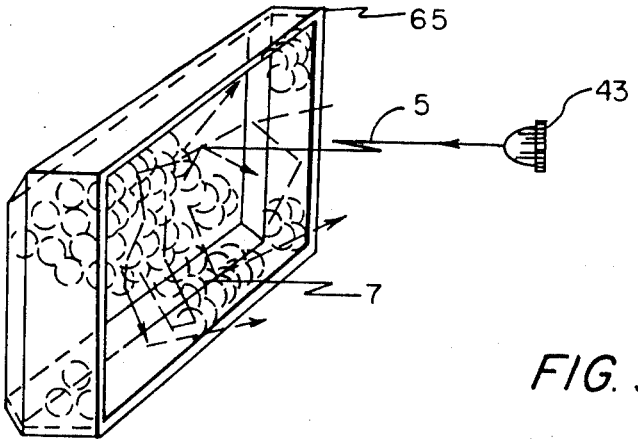
FIG. 9 is a view of another embodiment of the distributor or means defined as a mix of dispersive particles contained in a simple housing.

FIG. 9 depicts the encoder region of the distributor means 7 being composed of a housing 65 containing a transmissive-dispersive-heterogeneous mix of particles, such as glass spheres or other transmissive polyhedrons or shapes, interspersed with voids which may be evacuated, filled with a fluid (liquid and/or gas), and/or contain particles of various geometries.

FIG. 10 depicts a preferred embodiment of the encoder region distributor means 7 as a solid transmissive refractive-dispersive substance, e.g. glass, plastic, crystal, ceramic, or epoxy having transducer means 43 embedded therein, with the inside surface of the encoder housing 65 being mirrored or coated, as in FIG. 8, for reflection; the composite thus providing for refracto-reflecto dispersion of emissions 5 into radiation field 9 form. Further, should the reflective coating be applied directly to the entire outer surface of the solid dispersive substance employed (except the output coupled to screen 21), the encoder region of distributor means 7, with transducer means 43 imbedded therein, becomes a practical embodiment of encoder 11, itself.

Various other means for establishing radiation field 9 from emissions 5 of the present invention may be employed by those skilled in the art; with the application of elements such as lenses, mirrors, gratings, diffusers, and prisms being appropriate.

Shown in FIG. 2, is a functional block diagram of the address controller means 23 of the invention. Vertical generator 31 is the row pulse timing generator which provides an appropriate digital pulse train to row driver 35. Driver 35, in a sequential-distributed-parallel manner, in effect switches pulse elements of the train as they arrive; thus enabling the sequential actuation of row address lines 17 so as to drive attendant row electrodes 39 within the screen 21.

Horizontal generator 33 is the column pulse timing generator which provides an appropriate digital pulse train to column driver 37. Driver 37, in a sequential-distrubuted-parallel manner, in effect switches pulse elements of the train as they arrive; thus enabling the sequential actuation of column address lines 19 so as to drive attendant column electrodes 41 within the screen 21.

The sense of polarity and the voltage amplitude of the pulses applied to electrodes 39 and 41, through the foregoing means and methods, is such as to actuate the RyCx light-gates of screen 21. Vertical generator 31 and horizontal generator 33 of controller means 23 may be conventioal digital pulse timing and generating devices similar to the TTL type SN54S124 (Texas Instruments, Inc. Dallas TX.)

Row driver 35 and column driver 37 may be devices similar to each other, such as the ICM 7281 type driver (Intersil, Inc., Santa Clara, CA). While these particular devices provide for driving only thirty output lines each, a multiple number may be readily employed so as fields 9 and utilized for many displays from a single encoder 11 source. In a representative configuration, FIG. 16 illustrates an imaging cube 63 wherein five imaging surfaces are formed with five identical screens 21. The sixth surface region contains converter means 3. It is also possible to provide for imaging on all six cube surfaces by those skilled in the art; and to provide for more than six imaging surfaces through other geometries or configurations obtainable.

The function distributor means 7 is provided through the enclosed region of six surfaces inside the image cube 63, which may be considered to comprise encoder 11 in the instant example. These surfaces are comprised of the convertor 3 and five input polarizer 47 surfaces of five screens 21 (FIG. 6). Egress of fields 9 is only as provided through screens 21 as in the previously described methods of the invention. While other imaging configurations utilizing fields 9 may be conceived and applied through the methods and/or means disclosed herein, all such configurations will be seen to exploit the versatility, efficiency, and fundamental concepts and methods of the present invention.

Having thusly described by invention, I claim:

1. A display device for producing an image comprised of a plurality of pixels, said device comprising:

at least a first and a second light means, each light means for producing in individual response to a video signal visible light radiations having a color different from the other light means;

means for mixing said color radiations;

light screen means for confining said mixed light, said light screen means comprised of a plurality of individually addressable light gates for permitting, when addressed, said mixed color radiations to be emitted; and means for selectively addressing said light gates in a timed relationship to said video signal such that a composite multi-color display is produced.

2. A device as claimed in claim 1 wherein said mixing means comprises passive optical means for mixing said color radiations.

3. A device as claimed in claim 2 wherein said passive optical means includes transmissive light guide means.

4. A device as claimed in claim 2 wherein said passive optical means produces a substantially isochronously perceived, substantially isotropic field of radiation.

5. A device as claimed in claim 1 wherein said light-gates are binary light-gates so that when addressed, light radiation is emitted and when not addressed substantially no light radiation is emitted.

6. A device as claimed in claim 5 wherein said light screen means comprises a contiguous plurality of said binary light-gates.

7. A device as claimed in claim 6 wherein said light screen means further comprises crossed polarizers, transparent electrode lines, and an electro-optical material.

8. A device as claimed in claim 1 wherein at least one of said first and second light means comprises discrete colored light emitting diodes.

9. A device as claimed in claim 1 wherein at least one of said first and second light means comprises discrete colored lasers.

10. A display device comprising:

a housing having a cavity therein, wherein said cavity is defined by a light impervious surface and said housing further comprising an opening in one portion of said surface, said opening being in communication with said cavity;

a first light means for producing chromatic light radiation of variable intensity in said cavity;

a second light means for producing chromatic light radiation of variable intensity in said cavity that is different from said radiation produced by said first light means;

an optical screen covering said opening and illuminated by said light radiation, said screen comprised of a plurality of individually addressable light gate means for emitting, when addressed, a pixel of chromatic light radiation from said cavity through said screen;

means for providing a video signal to said first and second light means for individually varying the intensity of said light radiation produced by each light means;

means for individually addressing said light gates in a timed relationship to said video signal such that a composite multiple colored display comprised of said pixels of light is produced by said display device; and means for mixing said chromatic radiations so as to produce a substantially isochroous, substantially isotropic field.

11. A display device as claimed in claim 10 wherein said mixing means comprises passive optical elements.

12. A display device as claimed in claim 11 wherein said passive optical elements include reflector means covering the cavity side of said housing surface for reflecting optical radiation incident thereon, and light dispersive and diffractive means for scattering and mixing said optical emissions.

13. A method for producing an image comprised of a plurality of pixels, said method comprising:

providing a video signal;

producing in response to said video signal visible light radiation from a plurality of light means, each light means producing color emissions different from any other of said light means;

mixing said color radiations within a confining housing comprised of a light screen means having a plurality of individually addressable light gates for permitting, when addressed, said mixed light radiations to be emitted as a pixel of light; and selectively addressing said light gates in a timed relationship to said video signal such that a composite multi-color display is produced.

14. A method for producing an image as claimed in claim 13 wherein said mixing step produces a substantially isochroous, substantially isotropic field.

15. A method for producing an image as claimed in claim 14 wherein said video signal controls the intensity of the emissions of said light means such that a continuous band of color radiation is produced by varying the emission intensity of said light means.

* * * * *